United States Patent [19]

Sarka et al.

[11] Patent Number: 4,528,762

[45] Date of Patent: Jul. 16, 1985

[54] PLOW BLADE MOUNTING WITH ENGAGABLE ABUTTING ELEMENTS

[75] Inventors: Stephen F. Sarka, Euclid; Wayne J. Abarca, Cleveland; James R. Johnson, Moreland Hills; Charles J. Smick, Jr., N. Ridgeville, all of Ohio

[73] Assignee: Meyer Products, Inc., Cleveland, Ohio

[21] Appl. No.: 656,274

[22] Filed: Oct. 1, 1984

[51] Int. Cl.[3] ..... E01H 5/04

[52] U.S. Cl. ..... 37/236; 172/829; 37/279

[58] Field of Search ..... 37/279, 293, 234–236; 172/811, 818–819, 828–829

[56] References Cited

U.S. PATENT DOCUMENTS

| | | | |
|---|---|---|---|
| 1,698,809 | 1/1929 | Angell | 37/279 |
| 2,088,564 | 8/1937 | Anthony et al. | 37/279 |
| 2,103,775 | 12/1937 | Frink | 37/279 X |
| 3,746,368 | 7/1973 | Gledhill et al. | 37/236 X |
| 3,793,752 | 2/1974 | Snyder | 37/234 |
| 3,987,562 | 10/1976 | Deen et al. | 37/236 |
| 4,187,624 | 2/1980 | Blau | 37/234 |
| 4,215,494 | 8/1980 | Farrell et al. | 37/236 |
| 4,215,496 | 8/1980 | Wehr | 172/829 X |
| 4,244,122 | 1/1981 | Hetrick | 37/234 |

*Primary Examiner*—E. H. Eickholt

*Attorney, Agent, or Firm*—Body, Vickers & Daniels

[57] ABSTRACT

There is provided an improvement in a device for mounting a plow blade onto the front of a motor vehicle. The mounting device includes a frame member having a forwarldy facing, first end and a rearwardly facing second end, means for mounting the blade onto the first end of the frame member known as an A-frame and means for securing the A-frame at the second end onto the vehicle for pivotal movement about the first axis extending transversely across the front of the vehicle. This type of blade mounting device also includes a lift means for pivoting the A-frame or frame member upwardly about the first axis and against the weight of the plow blade to raise the plow blade from its plowing position. This lift means also allows the A-frame by the weight of the A-frame and plow blade to pivot downwardly into the lowered plowing position when desired. The improvement in this type of mounting arrangement is forming securing means between the A-frame and the vehicle as an intermediate link member or assembly which assembly is pivoted onto the A-frame at one end and onto the vehicle at the other end. The A-frame can and will pivot around the standard lifting axis as previously described until the blade is raised a limited amount. The link member or assembly has means for locking the link member or assembly with respect to the A-frame when the blade and A-frame are in their plowing positions to allow the vehicle to push the blade through the link member or assembly. This link member or assembly has a second position which is snapped into as the A-frame is tilted upwardly by the lift mechanism or means. In this second position, the front end of the A-frame is lowered to increase visibility of the driver and stability of the vehicle as it is operated with blade in the raised, non-plowing position.

7 Claims, 9 Drawing Figures

FIG. 4
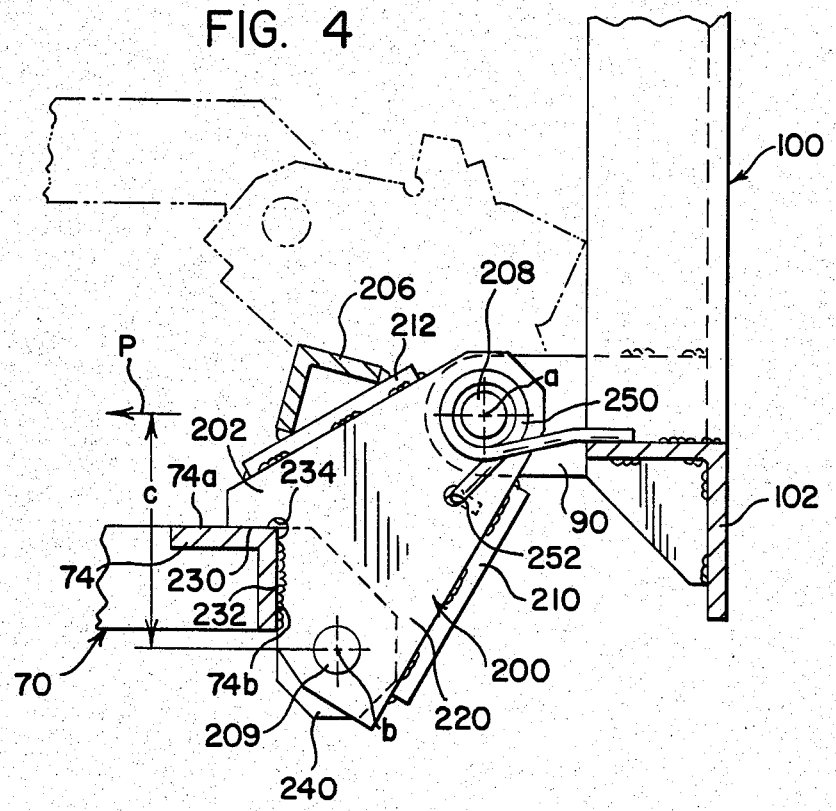
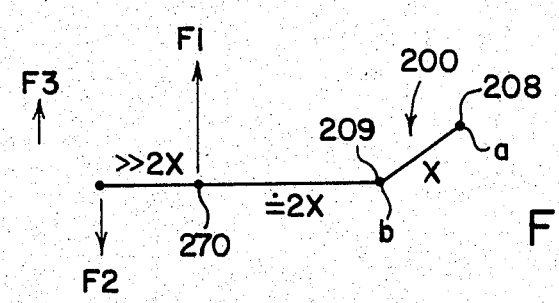
FIG. 5

PLOW BLADE MOUNTING WITH ENGAGABLE ABUTTING ELEMENTS

The present invention relates to the art of mounting a plow blade on the front of a motor vehicle of the type used for snow removal as the vehicle moves along the roadway and more particularly to an improved mounting device for manipulating the blade as it is shifted between a plowing, lowered position and raised, non-plowing position.

BACKGROUND OF THE INVENTION

It is common practice to plow roadways by a plow blade mounted on the front of a motor vehicle. One of the most common type of mounting arrangements for a plowing blade is that used by individuals on their personal trucks or four wheel drive vehicles. The blade is mounted on a curved steel member known as a "sector" and is adapted to oscillate in either direction along a supporting frame known as an A-frame. By providing an upper arm pivoted by a hydraulic cylinder, a chain extending from the arm downwardly toward the A-frame can be used to selectively lift the A-frame, sector and plow blade in unison into the non-plowing position. By releasing the pressure on the cylinder, the weight of the blade itself moves the A-frame, sector and blade downwardly until the lower edge of the plow blade engages the roadway surface. This is the lowered plowing position of the blade. This mounting mechanism is relatively inexpensive, has been used for many years and is quite well known as a reliable arrangement for converting a vehicle into a device for clearing snow and other debris from roadways.

For municipal applications, larger plow blades are used on heavier trucks to perform heavy duty removal of snow. Such applications have resulted in a variety of mounting mechanisms for moving the plow blade from its raised position to its lowered plowing position. These mechanisms have been especially engineered, are low production and are costly. Attempts to use, for municipal plowing, the relatively inexpensive, simple and well tested personal type of blade mounting and lifting concepts utilizing an A-frame pulled upwardly for lifting a plow blade have not been successful. One of the basic disadvantages is caused by the relatively large size of plow blades used for such municipal plowing. When this blade is pivoted upwardly on an A-frame, it tends to obstruct the vision of the driver operating the motor vehicle. This is pronounced when the blade is angled to one side or the other which is the normal condition for plowing roadways. Also, the raised position of the large blade is quite high to provide clearance when the plowing operation is not being performed. This high, raised position causes instability of the vehicle and substantial strain on the mounting arrangement. For these reasons, the standard individual blade mounting mechanism has not been widely adopted by municipal plowing operators. Consequently, special low production, high cost mounting devices are generally used for municipal plowing vehicles.

THE INVENTION

The present invention overcomes the difficulties mentioned above by allowing a standard blade mounting arrangement used for small vehicles to be converted to municipal mounting devices without substantial modifications.

In accordance with the present invention, there is provided an improvement in a standard plow blade mounting structure of the type including a sector, A-frame and lift mechanism. This improvement involves a modification of the means for securing the A-frame onto the front of the vehicle. This improved securing means is a link member or assembly extending between the vehicle and the back end of the A-frame and is pivotally mounted to pivot at the A-frame about a second axis parallel to the normal pivotal axis used in a standard pivotal mounting arrangement. Also, the link assembly is provided with means for locking the link member or assembly with respect to the A-frame when the A-frame and plow blade are in the plowing position to allow the vehicle to push the plow blade through the link member as a rigid structure.

In accordance with another aspect of the invention, the locking arrangement between the A-frame and the link member or assembly involves an abutment element on the link member or assembly and an abutment element on the A-frame and means for engaging these two abutment elements when the A-frame is in the locked, lowered position.

Still a further aspect of the present invention is the provision of an improved mounting arrangement as discussed above wherein the link member or assembly has a first relative position with respect to the A-frame when the A-frame is in the plowing position. This first relative position is with the link member or assembly being generally above the frame member so that it depends below the standard axis of the total mounting mechanism. The link member or assembly also has a second relative position with respect to the A-frame when the A-frame is in the non-plowing position. This second relative position is with the link member assembly being generally below the A-frame. In accordance with the preferred embodiment of the invention, the link member snaps between the two positions as the A-frame is lifted upwardly during the lifting operation and as the A-frame is lowered by the weight of the blade during the lowering operation.

Still a further aspect of the present invention is the provision of an improved mounting arrangement, including the intermediate link member or assembly defined above, which mounting arrangement also includes a chain, or other lifting strand, extending from a lift arm to the A-frame or an associated structure at an intermediate position between the blade and the rearward link assembly so that as the A-frame is lifted upwardly, the A-frame tends to pivot around the chain connected, intermediate position by the weight of the blade. This enhances the snap action previously described. In accordance with this aspect of the invention, a further chain is provided near the front of the A-frame so that the amount of tilting, oscillating or pivoting about the basic chain connecting points is limited. In this manner, the A-frame can move upwardly and downwardly while remaining in a generally horizontal disposition.

The primary object of the present invention is the provision of an improved device for mounting a plow blade onto the front of a motor vehicle, which device is usable for municipal plowing operations and employs a somewhat standard mounting concept.

Another object of the present invention is the provision of an improved device for mounting a plow blade, as discussed above, which improved device uses generally standard sector and A-frame elements of high production mounting devices with an interconnecting linkage mechanism to enhance visibility when the blade is in the raised position and to provide stability for shifting the blade while the A-frame remains in a substantially horizontal raised position.

Still another object of the present invention is the provision of an improved device for mounting a plow blade, as defined above, which improved device has improved visibility especially when the plow blade is in the angled position.

Another object of the present invention is the provision of an improved device for mounting a plow blade, as defined above, which improved device provides adequate ground clearance without substantial impairment to visibility by the operator of the vehicle using the blade.

Still a further object of the present invention is the provision of an improved device for mounting a plow blade, which improved device allows the blade to ride at a lower position when in the non-plowing arrangement to reduce transverse instability of the vehicle.

Yet another object of the present invention is the provision of an improved device for mounting a plow blade as defined above, which device can be removed from a vehicle by a very inexpensive, convenient and easy arrangement.

These and other objects and advantages will become apparent from the following description taken together with the accompanying drawings which are described below.

BRIEF DESCRIPTION OF THE DRAWINGS

In the disclosure, the following drawings are employed:

FIG. 4 is an enlarged view showing the link member or link assembly constructed in accordance with the preferred embodiment of the present invention;

FIG. 5 is a schematic force coupling diagram showing certain operating characteristics of the present invention;

PREFERRED EMBODIMENT

Figure 1:
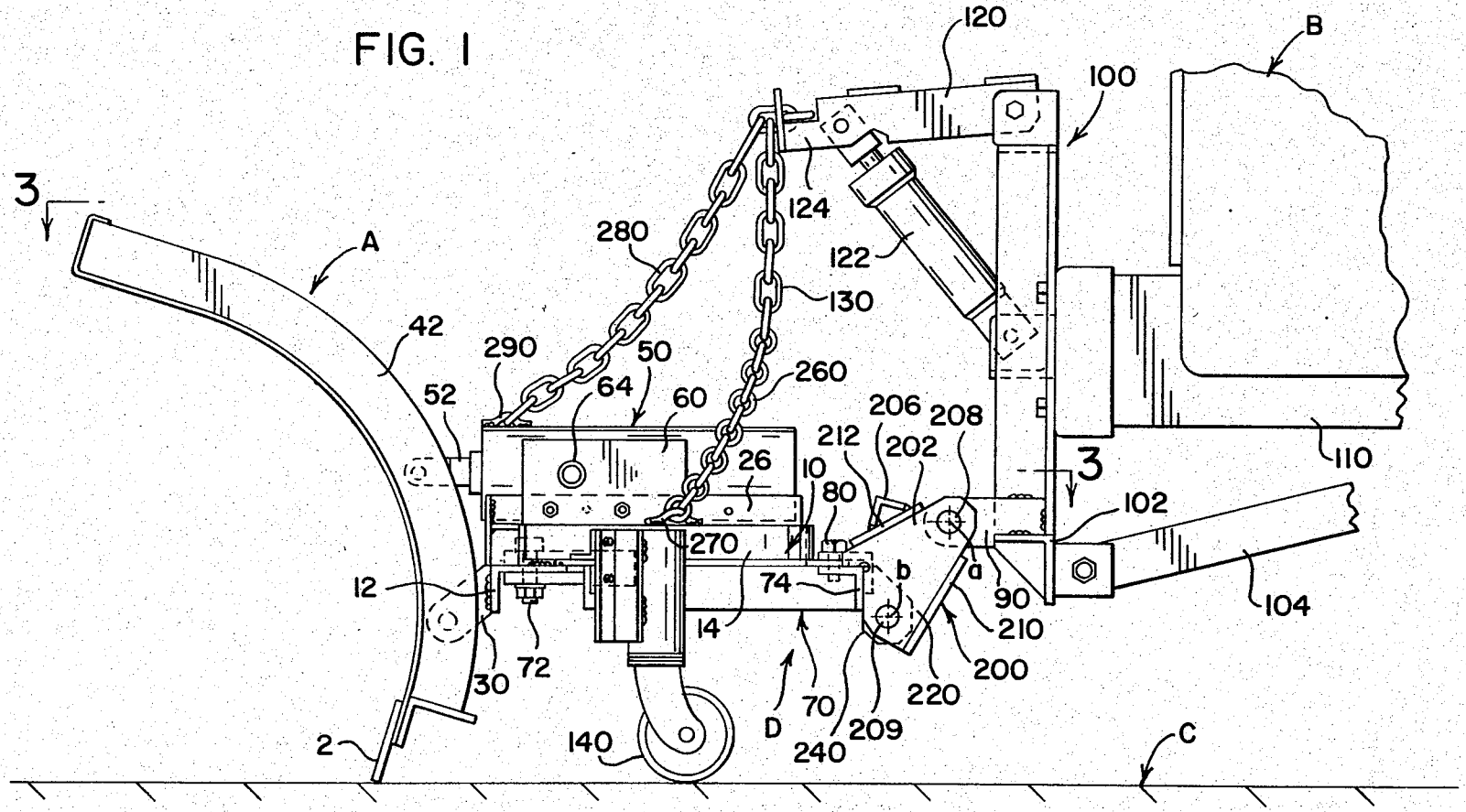
FIG. 1 is a side elevational view of the preferred embodiment of the present invention.
Figure 2:
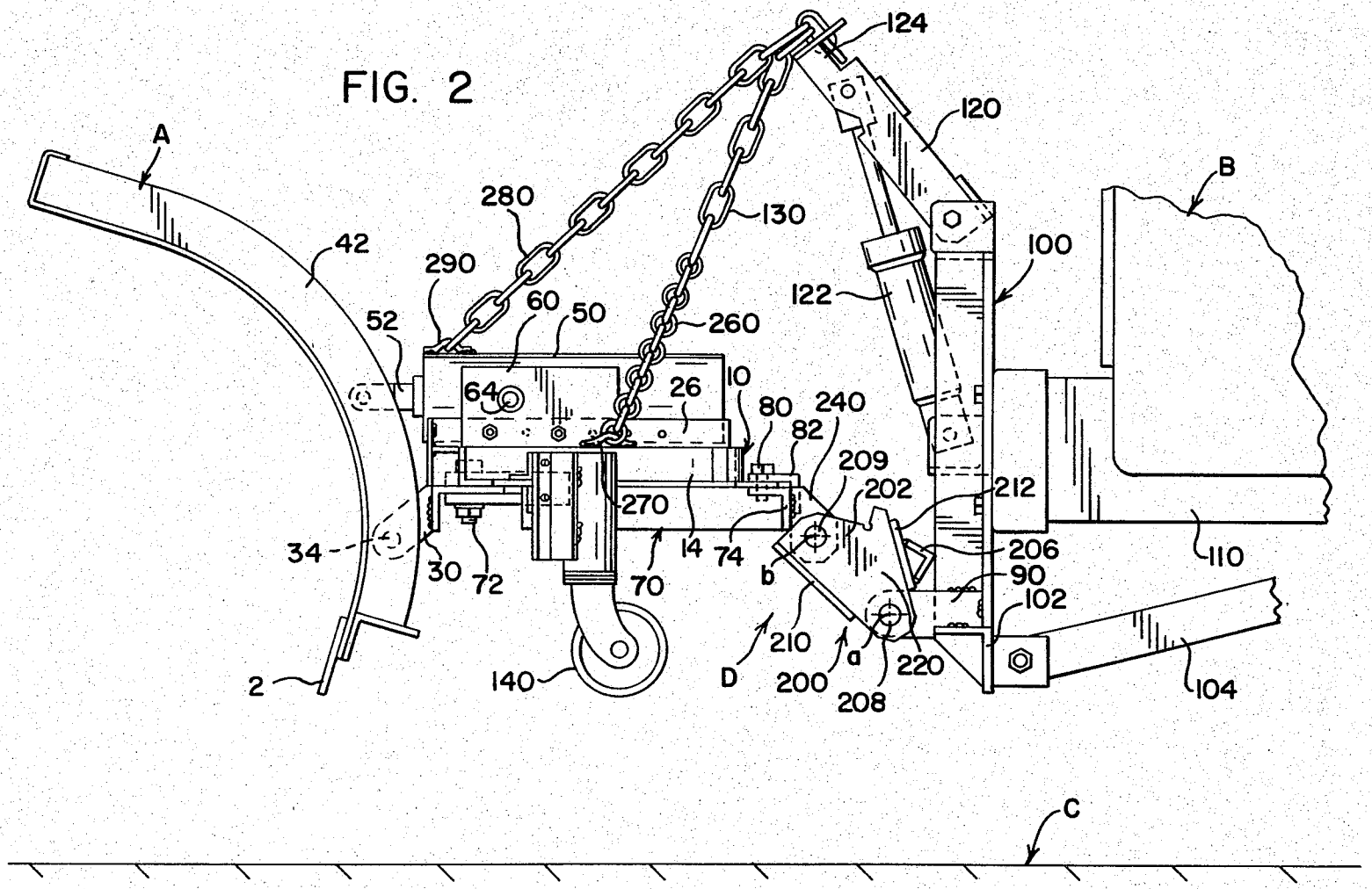
FIG. 2 is a side elevational view, as shown in FIG. 1, with the plow blade lifted into the non-plowing, transport position.
Figure 3:
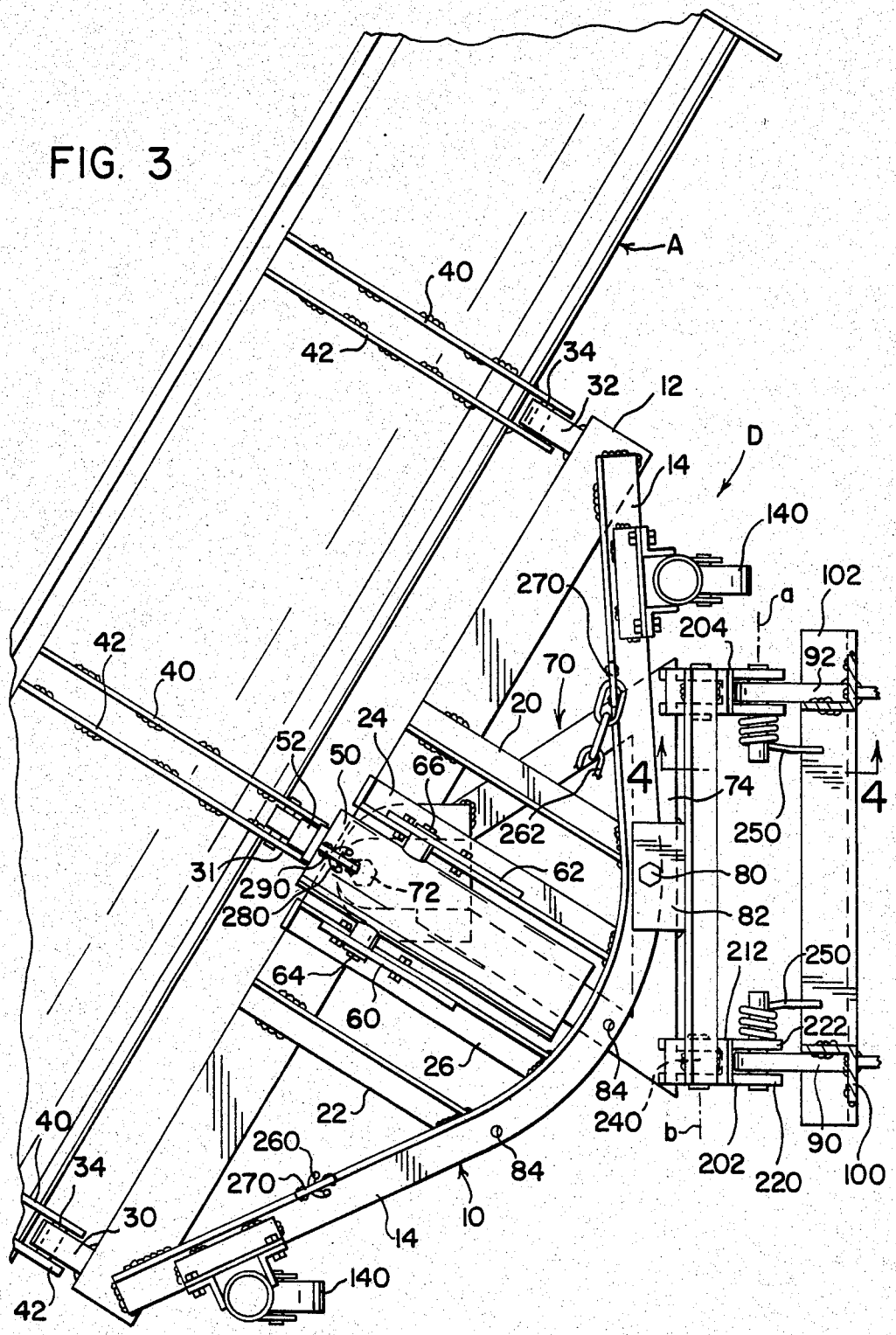
FIG. 3 is a top view taken generally along line 3—3 of FIG. 1.

Referring now to the drawings wherein the showings are for the purpose of illustrating a preferred embodiment of the invention only and not for the purpose of limiting same, FIGS. 1, 2 and 3 show a standard moldboard type plow blade A attached to the front of a motor vehicle B for the purpose of plowing along a roadway C as the motor vehicle is moving forward. The present invention is particularly applicable for use with a municipal type of vehicle wherein the blade A is relatively large and the vehicle B is a heavy duty vehicle, such as a municipal dump truck. The present invention relates to a mechanism allowing the use of a relatively standard mounting concept successfully employed in smaller vehicles for many years. The moldboard plow blade does not form a part of the present invention and it has somewhat standard construction with an inwardly concave surface and a lower plowing edge 2, usually formed of a metal strip.

The improved mounting structure D constructed in accordance with the present invention employs a variety of somewhat standard components, such as a sector 10, best shown in FIG. 3, having a generally straight front bar 12 and a rearwardly extending arcuate angle iron brace 14 with laterally extending generally flat portions welded to the front bar to form a rigid unitary structure. Support struts 20, 22, 24 and 26 extend between sector bar 12 and brace 14 for the purpose of structurally rigidifying the sector to perform the lifting and supporting function attributed to this particular component of mounting structure D. Laterally spaced downwardly extending journal blocks 30, 31 and 32 receive pins 34 for pivotally supporting blade A about a lower axis adjacent edge 2. Pins 34 extend through one of several sets of straps 40, 42. These sets are axially spaced along the curved moldboard for adding rigidity to the moldboard itself and also for providing a plurality of reinforced connections, as illustrated best in FIG. 3. In accordance with standard practice, blade A can trip forward when edge 2 encounters an obstruction on the roadway C. To accomplish this controlled tripping action, a pivotally mounted spring cylinder 50 has an outwardly extending plunger 52 connected between another set of straps 40, 42 by an appropriate pin connection. Plates 60, 62 are bolted onto support struts 24, 26 to provide upper trunnions 64, 66 to pivotally mount cylinder 50. In this manner, a compression spring within the cylinder acts between the plates and the plow blade. Other tripping mechanisms could be employed; however, the cylinder type tripping mechanism is shown for illustrative purposes and it is best adapted for municipal type blades employing the preferred embodiment of the present invention.

As in prior mounting units, the improved structure D includes an A-frame 70 terminating in a forward nose where a kingpin arrangement 72 pivotally mounts the sector 10 for oscillation about the kingpin and on the top surface of the A-frame. In practice, hydraulic cylinders can be used to control the plowing angle of the sector with respect to the A-frame; however, in the illustrated embodiment, pin 80 extends through angled bracket 82 and through one of the holes 84 in brace 14. By placing the bracket 82 over brace 14 at a position directly behind kingpin 72, the bracket precludes forward pivoting of the sector on the A-frame and also allows the arcuate portion of bracket 14 to move into at least three adjusted positions, as shown by the three holes 84. A-frame 70 is pivotally mounted about a primary or main pivot axis a defined by axially spaced lugs 90, 92 which are fixedly supported on vehicle B. Axis a extends laterally across the front of the vehicle and in the vicinity of the frame of the vehicle for the purposes of exerting a forward pushing force between mounting structure D and blade A, as the blade is used for plowing in the position shown in FIG. 1. An upstanding frame 100 has a lower transversely extending cross brace 102 which is used to reinforce the connection of frame 100 with a brace 104 adapted to be attached to the chassis or frame 110 of vehicle B. Plowing force is exerted by frame 110 and by brace 104 for pushing frame 100 forward. This frame, in turn, exerts a plowing force on blade A.

To raise A-frame 70 by pivoting it about axis a, a standard outwardly extending lift arm 120 is provided. A cylinder 122 is selectively extended by hydraulic fluid to oscillate arm 120 from the lowered rest position, shown in FIG. 1, to the upper lifted position, shown in FIG. 2. Arm 120 includes a forward position which is a chain coupling 124 for the purposes of attaching sector 10 onto pivot arm 120 by an appropriate flexible, non-extendable lifting strand in the form of a chain 130. Casters or rollers 140 are sometimes employed for the purposes of supporting the mounting structure D rearwardly of blade A. These are optional wheels or casters which need not be employed for the purposes of the present invention.

Figure 6:
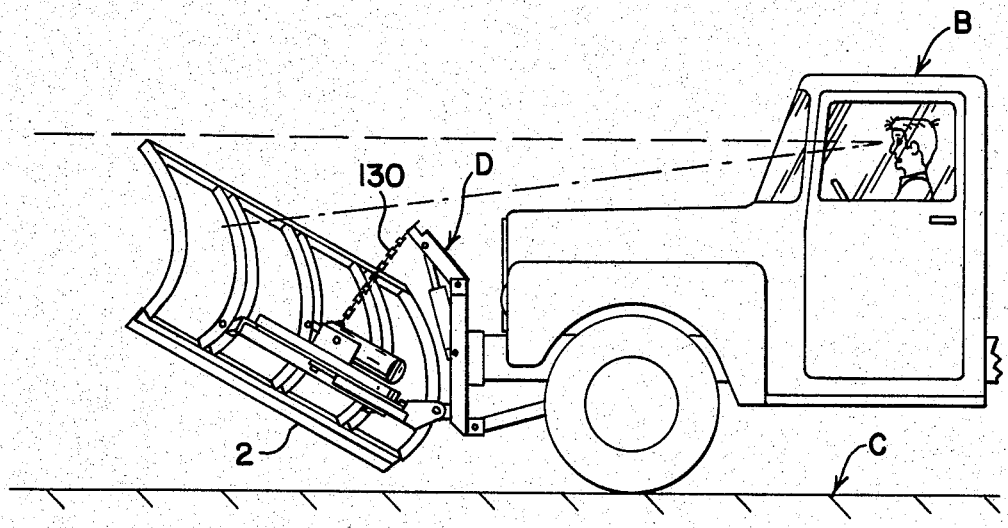
FIG. 6 is an illustration of an attempt to combine a standard pivoted mechanism for mounting a plow blade on the front of a municipal truck and illustrating the blade in the angled position.
Figure 7:
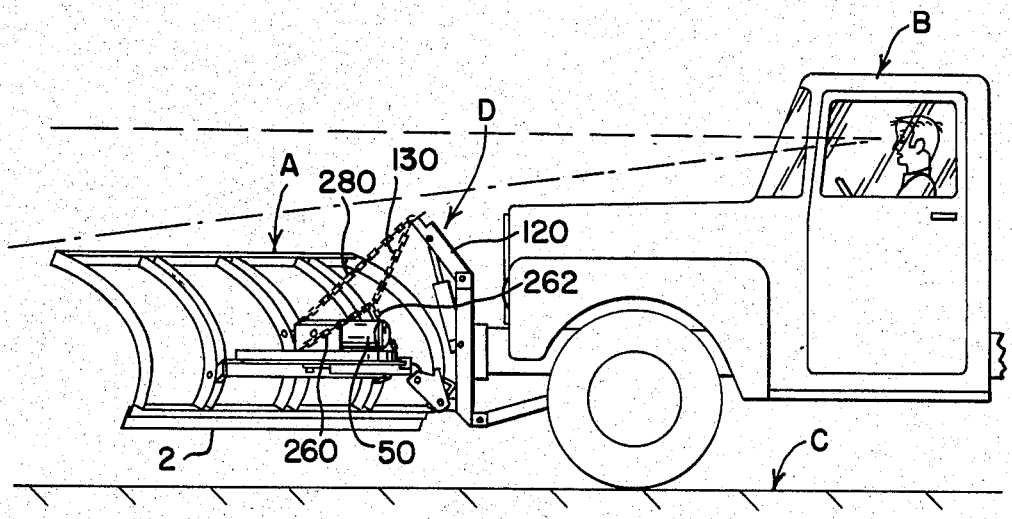
FIG. 7 is an illustration similar to FIG. 6 employing the present invention and showing the blade still in the angled position.
Figure 8:
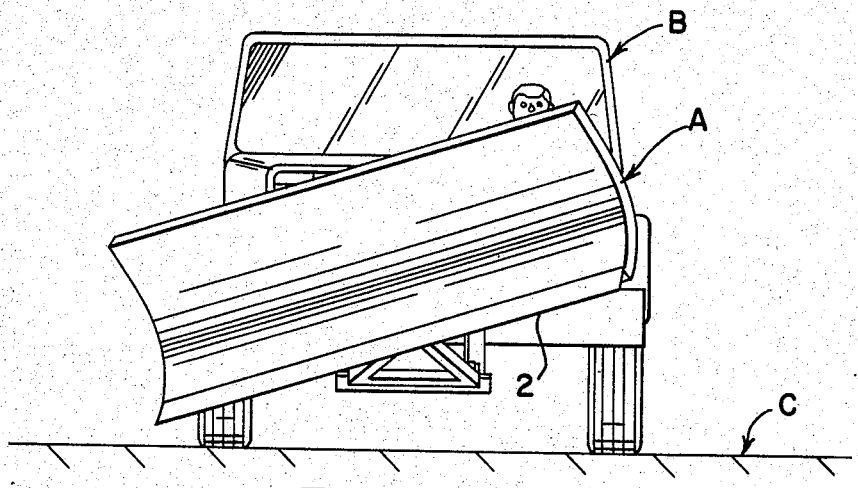
FIG. 8 is a front view of FIG. 6.
Figure 9:
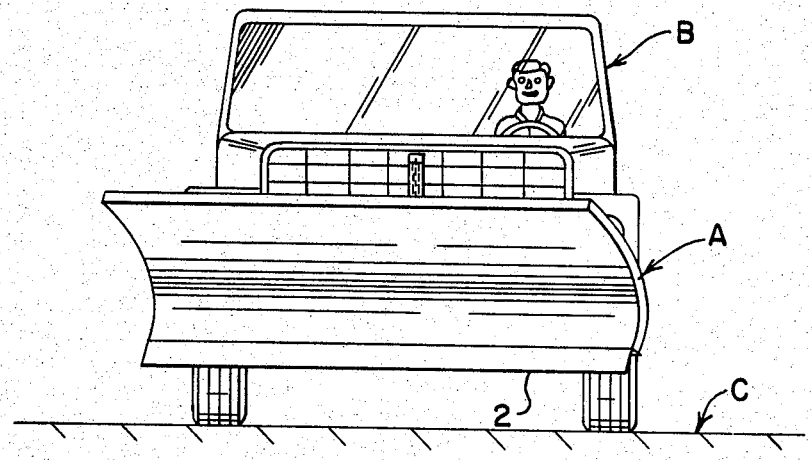
FIG. 9 is a front view of FIG. 7.

As so far described, the mounting structure D is not substantially different from the mounting structure now employed in small domestic vehicles, such as small pick-up trucks and four wheel drive vehicles. The blade is connected onto the vehicle at lugs 90, 92 and a chain 130 is connected between the mounting structure and coupling portion 124 of lift arm 120. To transport the blade, cylinder 122 forces arm 120 upwardly. This lifts blade A into the transport position. At that time, hydraulic fluid is locked in cylinder 122 and the blade can be transported from place-to-place without performing a plowing action. When the blade is to be used to plow, fluid is gradually exhausted from cylinder 122 and blade A is lowered in a controlled fashion downwardly until edge 2 engages roadway C. Thereafter, vehicle B moves forward. If the blade is to be angled, pin 80 is removed and sector 10 is angled over A-frame 70. Pin 80 is returned to an appropriate hole 84 and the blade is at the right or left angled position or the straight position. Of course, cylinders can be used for causing the blade to be angled hydraulically from a controlled module normally provided in the truck cab. If the blade were pivoted upwardly in an angled position about axis a, the blade would have an upward, lifted position as shown in FIGS. 6 and 8. As can be seen, this upward position obstructs forward vision. In addition, the distribution of weight in this upward position is such that the vehicle may have substantial tendency to be unstable.

The present invention is an improvement wherein the mounting structure D is provided with a link assembly 200 including two transversely spaced link members 202, 204 secured together transversely by a rigidifying cross beam 206. Link members 200, 204 are substantially identical and are spaced transversely along axis a. A detailed description of link member 202 applies equally to its companion spaced link member 204; therefore, for the purposes of simplicity only this one link member will be described in detail. Link member 202 includes a pin 208 which is at the main axis a and forms a standard coupling arrangement for interconnecting the mounting structure D on the vehicle. A second pin 209 produces a second, auxiliary transversely extending pivot axis b parallel to axis a and movable in a fixed arc about this axis. Member 202 includes lower cross plate 210 and upper cross plate 212 extending between axially spaced side plates 220, 222, each of which is the same and has a specific companion shape at least adjacent axis b and at a position offset from a geometric plane defined by axes a and b. This special shape is best shown in FIG. 4 and includes, as a primary aspect, two generally orthogonal, abutment shoulders 230, 232 above axis b and separate by an appropriate relief bore 234, which is formed by a drill during the process of accurately cutting abutment shoulders 230, 232. These orthogonal shoulders engage right angled surfaces **74*a*, 74*b* of transversely extending rear angle iron 74 of A-frame 70 when the A-frame is in the lowered position, shown in FIGS. 1 and 4. A force P is exerted in a forward direction by lugs 90, 92 and is spaced upwardly from auxiliary axis b a distance c. This spacing creates a force couple tending to rotate link assembly 200. Shoulder 230 engages upper surface 74*a* to prevent this counterclockwise rotation of link member 202, as shown in FIG. 4. This produces a locking action so that the A-frame is locked with respect to link assembly 200 during the plowing action. This locking action provides a rigid structure similar to a welded structure so that there is positive, uninhibited direct driving force on the A-frame, which force is transmitted through the kingpin 72 to the plow blade A for an efficient plowing action. To form the pivoted axis b between the A-frame and link assembly 200, the A-frame is provided with to rearwardly extending lugs or fingers 240 extending between plates 220, 222 and receiving the pivot pin 209. These downwardly depending fingers or lugs define the distance between abutting surfaces 74*a*, 74*b* and the actual, auxiliary axis b. In accordance with an optional aspect of the invention, torsion springs 250 can be provided around one or both of the pins 208 to create a torque between brace 102 and an appropriate spring opening 252 in one of the plates 210 or 212. This torsion spring arrangement will cushion the snapping action of link assembly 200 as the links 202, 204** are shifted between the lowered, locked, plowing position and the upper, unlocked, transport position.

The advantage obtained by using link assembly 200 between frame 100 and A-frame 70 is realized when the blade A is lifted by an upward force and lowered in a controlled fashion by cylinder 122. In accordance with the present invention, chain 130 includes two branches 260, 262 connected at connectors 270 to the sector 10. Connectors 270 are closer to the blade pivot pins 34 than they are to the rear pivot axis b. The primary weight of mounting structure D is the blade itself; therefore, by moving connections 270 toward the blade, there is a tendency to equalize the reverse turning movement on both sides of a line extending transversely and intersecting the two spaced connectors 270 of chains 260, 262. This transverse line is parallel to main axis a and auxiliary axis b. The location of the axis or line defined by the spaced connectors 270 is such that blade A still tends to pivot structure D in a counterclockwise direction shown in FIGS. 1 and 2, especially when the A-frame is in a horizontal position, as shown in FIG. 2. To limit this rotation, a forwardly extending chain 280 is connected between chain coupling 24 of arm 120 and a forward connector 290 on cylinder 50. The forward chain 280 does not perform the basic lifting action, but is a stabilizing chain to preclude forward pivoting of blade A especially when the blade is being lowered back into the plowing position.

Referring now to FIGS. 1 and 2, 4 and 5, the operating characteristics of the invention are illustrated. Assume that the blade is in the lowered, plowing position shown in FIG. 1 and it is desired that it be moved to the transport position shown in FIG. 2. Link assembly 200 is in the locked plowing position shown in FIG. 4. A force F1, shown in FIG. 5, is exerted by chains 260, 262 as branches of the standard chain 130. When this occurs, a lifting action takes place at the axis defined by spaced chain connectors 270. This causes a tendency for the A-frame to rotate around main axis a. When the blade is lifted, the mass of the blade as it leaves the ground creates a force F2 that coacts with force F1 to cause a counterclockwise coupling or movement about axis 270. This action tends to break the lock between the shoulders 230, 232 and flat surfaces 74*a*, 74*b*. As the axis b travels in an arc defined by main axis a, there comes an instance or position where the coupling tending to break the locking action overcomes the force holding the shoulders in the locking position. When this occurs, a snap action rotates link assembly 200 about axis b at the same time the link assembly rotates about the axis a. This snap action releases the A-frame from the link and allows it to move horizontally upwardly by the action of the chain 130. Front chain 280 prevents blade A from undue forward tilting at the time when the locking action is broken. The reverse movement occurs when it is desired to lower the plow blade. As chain 130 lowers the blade, the A-frame remains in a general horizontal position as shown in FIG. 2. At a location or position during the lowering movement, the weight of the A-frame and the blade will tend to move the total assembly back toward the vehicle. When this occurs, there is a snap action which will shift the link assembly into the locked position for final tilting movement about main axis a. As can be seen, horizontal raising of the blade reduces the visual impairment from the cab and stabilizes the forwardly extending weight on the mounting arrangement.

Having thus defined the invention, the following is claimed:

1. In a device for mounting a plow blade onto the front of a motor vehicle, said device including a frame member having a forwardly facing first end and a rearwardly facing second end, means for mounting said blade onto said first end of said frame member, means for securing said frame member at said second end onto said vehicle for pivotal movement about a first axis extending transversely across the front of said motor vehicle, lift means for pivoting said frame member upwardly about said first axis and against the weight of said plow blade into a raised non-plowing position, said lift means including means for allowing said frame member to pivot downwardly into a lowered plowing position, the improvement comprising: wherein said securing means for said frame member is a link member extending between said vehicle and said second end of said frame member, means for pivotally mounting said link member to pivot at said frame member about a second axis parallel to said first axis and means for locking said link member against pivotal motion with respect to said frame member when in said plowing position to allow said vehicle to push said plow blade by said link member; and wherein said locking means includes an integral abutment element on said link member and an integral abutment element on said frame member said abutment elements being shaped to automatically lockingly engage against one another when said frame is in said plowing position and disengage when said plow is raised to said non-plowing position.

2. The improvement as defined in claim 1 wherein said link member has a first relative position with respect to said frame member when said frame member is in said plowing position, said first relative position being with said link member being generally above said frame member, and a second relative position with respect to said frame member when said frame member is in said non-plowing position, said second relative position being with said link member being generally below said frame member.

3. The improvement as defined in claim 2 wherein said lifting means includes a flexible, non-extendable lifting strand connected to said frame member at a selected position on said frame member closer to said first end than to said second end and pulled upwardly by a lift arm.

4. The improvement as defined in claim 3 including a support strand means adjacent said first end of said frame member and coacting with said lifting strand for limiting pivoting of said frame forwardly about said selected position when said lifting strand is lifting or lowering said frame member.

5. In a device for mounting a plow blade onto the front of a motor vehicle, said device including a frame member having a forwardly facing first end and a rearwardly facing second end, means for mounting said blade onto said first end of said frame member, means for securing said frame member at said second end onto said vehicle for pivotal movement about a first axis extending transversely across the front of said motor vehicle, lift means for pivoting said frame member upwardly about said first axis and against the weight of said plow blade into a raised non-plowing position, said lift means including means for allowing said frame member to pivot downwardly into a lowered plowing position, the improvement comprising: wherein said securing means for said frame member is a link member extending between said vehicle and said second end of said frame member, means for pivotally mounting said link member to pivot at said frame member about a second axis parallel to said first axis and means for locking said link member against pivotal motion with respect to said frame member when in said plowing position to allow said vehicle to push said plow blade by said link member; said locking means including an abutment element on said link member and an abutment element on said frame member and means for engaging said abutment elements when said frame is in said plowing position; and wherein said link member has a first relative position with respect to said frame member when said frame member is in said plowing position, said first relative position being with said link member being generally above said frame member, and a second relative position with respect to said frame member when said frame member is in said non-plowing position, said second relative position being with said link member being generally below said frame member.

6. The improvement as defined in claim 5 wherein said lifting means includes a flexible, non-extendable lifting strand connected to said frame member at a selected position on said frame member closer to said first end than to said second end and pulled upwardly by a lift arm.

7. The improvement as defined in claim 6 including a support strand means adjacent said first end of said frame member and coacting with said lifting strand for limiting pivoting of said frame forwardly about said selected position when said lifting strand is lifting or lowering said frame member.

* * * * *